US006785491B2

(12) United States Patent
Mitsu et al.

(10) Patent No.: US 6,785,491 B2
(45) Date of Patent: Aug. 31, 2004

(54) IMAGE FORMING APPARATUS HAVING AN INTERMEDIATE TRANSFER MEMBER

(75) Inventors: Hiroyuki Mitsu, Iwatsuki (JP); Masaki Suto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/365,470

(22) Filed: Feb. 13, 2003

(65) Prior Publication Data

US 2003/0219275 A1 Nov. 27, 2003

(30) Foreign Application Priority Data

May 24, 2002 (JP) ..... 2002-151051

(51) Int. Cl.[7] ..... G03G 15/16

(52) U.S. Cl. ..... 399/101; 399/297; 399/302; 399/354

(58) Field of Search ..... 399/101, 297, 399/302, 308, 353, 354, 360

(56) References Cited

U.S. PATENT DOCUMENTS 4,530,596 A * 7/1985 Kawamoto et al.
4,588,279 A * 5/1986 Fukuchi et al. ..... 399/308
6,081,679 A * 6/2000 Yamane et al.

FOREIGN PATENT DOCUMENTS

| | | |
|---|---|---|
| JP | A 4-29283 | 1/1992 |
| JP | A 6-59586 | 3/1994 |
| JP | A 6-148910 | 5/1994 |
| JP | A 10-333447 | 12/1998 |
| JP | A 11-231685 | 8/1999 |
| JP | A 2001-75448 | 3/2001 |
| JP | A 2001-142310 | 5/2001 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

To provide an image forming apparatus capable of reliably removing an untransferred residual toner from the surface of an intermediate transfer drum which is covered with an elastic layer, thereby enabling to form a recorded image having a high image quality with no ghost image, and capable of continuing to form recorded images having the high image quality over a long period of time without causing damage to the intermediate transfer drum. The intermediate transfer drum is structured such that the periphery of a metal base is covered with an elastic layer. As a toner discharging member for capturing a toner adhered to the intermediate transfer drum and discharging the toner as waste into a recovery box, there are provided a recovery roll that rotates while being in contact with the intermediate transfer drum and a scraper for scraping off a toner adhered to the surface of the recovery roll.

3 Claims, 4 Drawing Sheets

IMAGE FORMING APPARATUS HAVING AN INTERMEDIATE TRANSFER MEMBER

FIELD OF THE INVENTION AND RELATED ART STATEMENT

The present invention relates to an image forming apparatus such as an electrophotographic copying machine or a laser beam printer, and more particularly to an image forming apparatus of such a type that a toner image formed on an image bearing member such as a photosensitive drum is transferred onto a recording sheet via an intermediate transfer member.

Generally, in image forming apparatuses such as electrophotographic copying machines and laser beam printers, a toner image is formed on the surface of a photosensitive drum according to an image data. Then, the toner image is transferred onto a recording sheet, and the transferred toner image is heat-fixed to the recording sheet. Accordingly, a recording image is obtained. In recent year, there are also known full-color copying machines and full-color laser beam printers in which toner images formed on photosensitive drums are primarily transferred onto an intermediate transfer member, the toner images in four colors of yellow, cyan, magenta, and black are overlapped with each other on the intermediate transfer member, and then a resultant composite toner image is collectively secondarily transferred onto a recording sheet, to thereby form a full-color recorded image.

It is difficult to maintain a transfer efficiency for a toner image at 100%, so that an untransferred toner is likely to remain on the surface of the photosensitive drum after the toner image is transferred onto the recording sheet or the intermediate transfer member. Therefore, up to now, it is customary to provide a cleaning device on the downstream side of a transfer portion of the toner image and remove a residual toner prior to formation of the next toner image. Mainstream examples of such a cleaning device include a device in which a toner is scraped off from the surface of the photosensitive drum by a scraper (JP 06-148910 A) and a device in which a brush roll that rotates at high speed is made to slidingly contact the surface of the photosensitive drum (JP 04-29283 A). However, these cleaning devices have a defect in that the life of the photosensitive drum is likely to be shortened due to mechanical wear.

From this viewpoint, in recent years, there has been introduced an image forming apparatus in which, by increasing the transfer efficiency for a toner image to reduce the cleaning load on the photosensitive drum, the mechanical wear of the photosensitive drum is reduced (JP 2001-075448 A). More specifically, a spherical toner excellent in transfer efficiency is used, a rigid intermediate transfer drum is used as the intermediate transfer member onto which a toner image is primarily transferred, and an elastic layer whose resistivity is adjusted is provided on the surface of the intermediate transfer drum. Accordingly, the transfer efficiency for a toner image is increased and it becomes possible to continuously form images without providing the cleaning device for the photosensitive member.

On the other hand, the transfer efficiency for the toner image from the intermediate transfer drum onto the recording sheet is affected by environmental factors such as temperature and humidity, the type of the recording sheet, the moisture content of the recording sheet, and the like. Therefore, it is more difficult to increase the transfer efficiency of the intermediate transfer drum than that of the photosensitive drum. Also, in the case of a so-called tandem color image forming apparatus including the photosensitive drums for the colors of yellow, magenta, cyan, and black, the toner images in the respective colors are overlapped on the intermediate transfer drum. Therefore, the total amount of the toners thereon to be transferred is larger than the amount of the toners on the photosensitive drum. Accordingly, a larger amount of untransferred toners are likely to remain on the intermediate transfer drum than on the photosensitive drum, and the untransferred residual toners appear as a ghost image in the recorded image, so that there is high demand for providing a cleaning device for the intermediate transfer drum.

However, the elastic layer is formed on the surface of the intermediate transfer drum so as to increase the transfer efficiency between the intermediate transfer drum and the photosensitive drum. Thus, there is a problem in that, if the scraper is brought into pressure contact with the surface of the intermediate transfer drum, the elastic layer is likely to be damaged. Particularly, it is difficult to stably remove a spherical toner excellent in transfer efficiency by using a scraper formed of an elastic material such as a urethane rubber. Thus, it is unavoidably necessary to use a metallic scraper formed of an SUS or the like. If such a metallic scraper is used, the surface of the elastic member is damaged, and there is an extremely high probability of deteriorating the transfer efficiency.

Also, if the intermediate transfer drum is cleaned by using a brush roll, there is a problem in that irregularities are likely to occur in the elastic layer on the surface of the intermediate transfer drum due to its use over time, which leads to reduction in the transfer efficiency for a toner image.

OBJECT AND SUMMARY OF THE INVENTION

The present invention has been made in view of the above problems, and an object of the present invention is therefore to provide an image forming apparatus capable of reliably removing an untransferred residual toner from the surface of an intermediate transfer drum which is covered with an elastic layer, thereby enabling to form a recorded image having a high image quality with no ghost image, and capable of continuing to form recorded images having the high image quality over a long period of time without causing damage to the intermediate transfer drum.

In order to achieve the above-mentioned object, an image forming apparatus of the present invention is premised to include: an image bearing member on which a toner image corresponding to image information is formed; a final transfer roll for transferring the toner image onto a recording sheet; at least one intermediate transfer member for mediating a transfer of the toner image from the image bearing member onto the recording sheet, which is disposed between the image bearing member and the final transfer roll; and a toner discharging member for capturing a toner adhered on the intermediate transfer member and discharging the toner as waste into a recovery box, which is disposed to oppose the intermediate transfer member, and is characterized in that: the intermediate transfer member is structured as an intermediate transfer drum in which a periphery of a metal base formed into a cylindrical shape is covered with an elastic layer; and the toner discharging member has: a recovery roll that rotates while being in contact with the intermediate transfer drum; and a scraper for scraping off a toner adhered to a surface of the recovery roll.

In the above technical measure, there occurs no problem even if a peripheral speed of the recovery roll is the same as a peripheral speed of the intermediate transfer drum. From the viewpoint of removing the toner adhered on the intermediate transfer drum more efficiently, it is preferred that the peripheral speed of the recovery roll be different from that of the intermediate transfer drum. However, if the peripheral speed difference is excessively large, there occurs a so-called filming phenomenon in which the toners are rubbed over the surface of the intermediate transfer drum and thinly fixed on the surface. Therefore, it is preferred to set the above peripheral speed difference within 2% of the peripheral speed of the photosensitive drum.

Further, the recovery roll may be structured such that a metallic roll is directly brought into pressure contact with the intermediate transfer drum, or a surface of the metallic roll may be covered with the elastic layer. However, if a spherical toner is used as the toner, a metal plate is suitable for the scraper for scraping off the spherical toner adhered to the recovery roll. Thus, when taking into account the damage to the recovery roll due to the metallic scraper, it is preferred that the recovery roll itself be merely the metallic roll.

In addition, there occurs no problem as long as the recovery roll is in contact with the intermediate transfer drum at a certain level of pressure and the toner on the intermediate transfer drum is mechanically transited thereto. However, from the viewpoint of removing the toner on the intermediate transfer drum more efficiently, it is preferred to structure the apparatus such that a potential gradient is formed between the intermediate transfer drum and the recovery roll and the toner is electrically transited from the intermediate transfer drum to the recovery roll based on the potential gradient.

As a measure for forming the potential gradient between the intermediate transfer drum and the recovery roll, from the viewpoint that the transfer bias is applied to the intermediate transfer drum, it is preferred that the recovery roll be grounded via a resistor and a potential difference based on the resistance is formed between the intermediate transfer drum and the recovery roll. Also, it is conceivable to apply a cleaning bias directly to the recovery roll.

On the other hand, the untransferred and unnecessary toners remaining on the intermediate transfer drum include, in addition to the normal-polarity toner, a toner whose polarity is inverted due to Paschen discharge or charge injection in a transfer nip when passing through a transfer electric field, that is, a reversed-polarity toner. Therefore, if the cleaning bias is applied to the recovery roll, the toner that can be electrically captured due to the cleaning bias is a toner with only one of the polarities. Thus, in order to remove unnecessary toners with both the normal polarity and the reversed polarity from the surface of the intermediate transfer drum, there is provided a cleaning mode which is executed while an image forming operation is not executed, that is, before or after the image forming operation is executed. It is preferred to structure the apparatus such that the potential gradient formed between the intermediate transfer drum and the recovery roll is reversed between a case of the image forming operation and a case of executing the cleaning mode. Accordingly, by adopting a structure in which the potential gradient is reversed between the case of the image forming operation and the case of the cleaning mode, during the image forming operation, one of the normal-polarity toner and the reversed-polarity toner is transited from the intermediate transfer drum to the recovery roll. On the other hand, during the cleaning mode, the toner with the other polarity can be transited from the intermediate transfer drum to the recovery roll. At the end of the cleaning mode, both the normal-polarity toner and the reversed-polarity toner which are adhered to the intermediate transfer drum can be removed from the surface of the intermediate transfer drum.

Further, the reversed-polarity toner remaining on the intermediate transfer drum is transited backward along a potential gradient from the intermediate transfer drum to the photosensitive drum. Thus, if the reversed-polarity toner is not removed from the surface of the intermediate transfer drum during the image forming operation, the photosensitive member becomes contaminated with the reversed-polarity toner, and finally the charger for charging the photosensitive member becomes contaminated, which will lead to not only uneven charging of the photosensitive member but also uneven density of the recorded image. Accordingly, from the viewpoint of removing both the normal-polarity toner and the reversed-polarity toner from the intermediate transfer drum during the image forming operation and forming a recorded image with a high quality having no uneven density, the following structure is preferable. That is, a toner temporarily-holding member for electrically capturing a toner adhered to a surface of the intermediate transfer drum, which is in contact with the surface of the intermediate transfer drum, is provided on the upstream side of the toner discharging member with respect to a rotational direction of the intermediate transfer drum. During the image forming operation, the toner discharging member and the toner temporarily-holding member each remove a toner having a polarity reverse to each other from the surface of the intermediate transfer drum. When the cleaning mode is executed, the toner captured by the toner temporarily-holding member is transited to the intermediate transfer drum to be removed by the toner discharging member. In the above structure, all the toners of both polarities that remain on the intermediate transfer drum after transferring the toner image can be removed during the image forming operation, thereby enabling to prevent not only the contamination of the charger due to the reversed-polarity toner but also the uneven density of the recorded image. Also, it is unnecessary to provide a toner discharging member for each of the normal-polarity toner and the reversed-polarity toner, thereby enabling to downsize the image forming apparatus.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Hereinafter, an image forming apparatus of the present invention will be described in detail with reference to the accompanying drawings.

Figure 1:
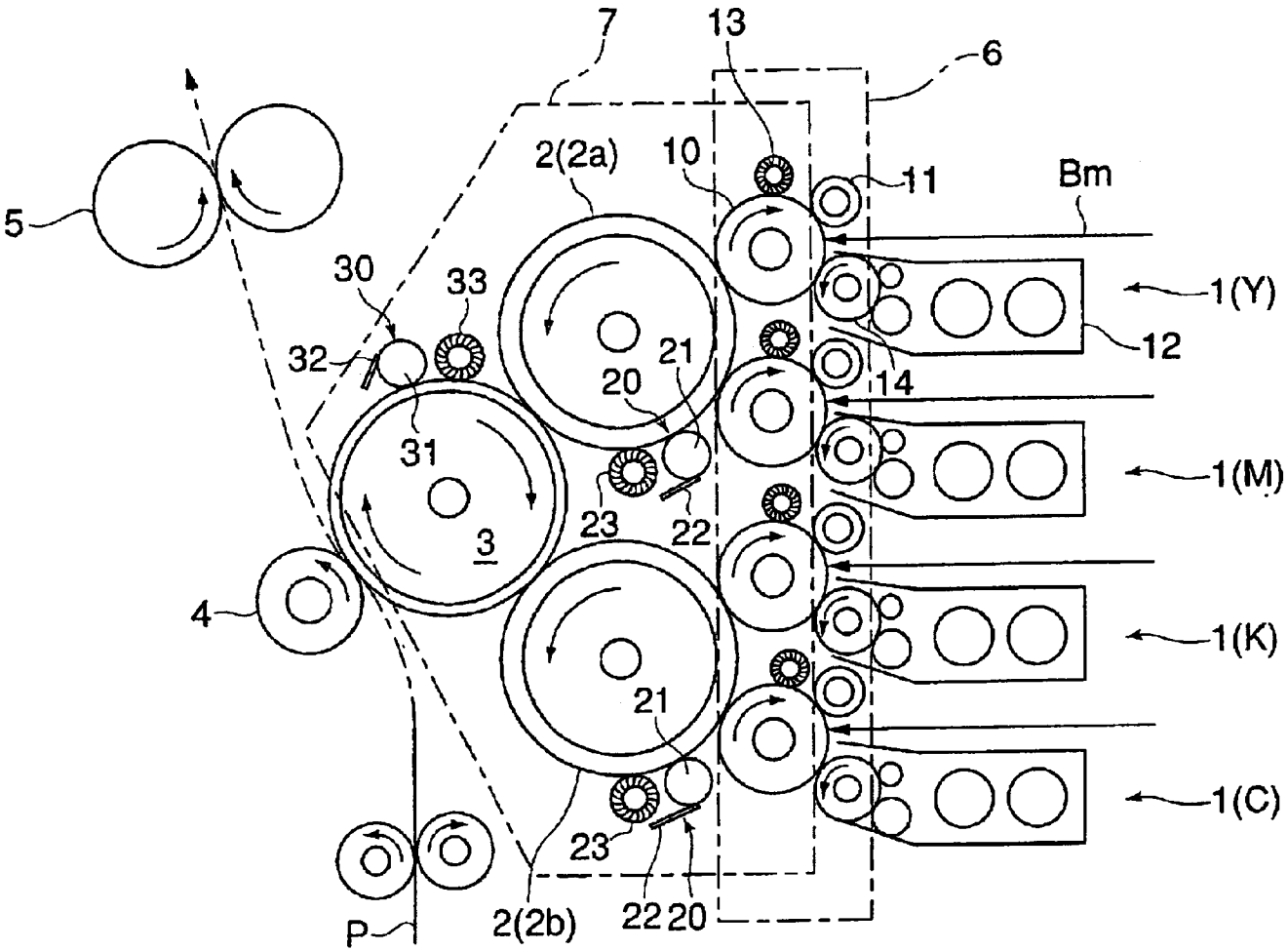
FIG. 1 is a schematic view showing a structure of a full-color laser beam printer to which the present invention is applied.

FIG. 1 shows a schematic structure of a full-color laser beam printer to which the present invention is applied. Note that the arrow in FIG. 1 indicates a rotational direction of each rotating member.

The full-color laser beam printer is a so-called tandem printer which includes image forming engines 1 for respective colors of yellow (Y), magenta (M), black (K), and cyan (C). In each image forming engines 1, a toner image corresponding to image information of each color is formed on each of photosensitive drums 10 at a predetermined timing. Also, the toner image formed on each photosensitive drum 10 is primarily transferred onto a first intermediate transfer drum 2, then secondarily transferred from the first intermediate transfer drum 2 onto a second intermediate transfer drum 3, and finally transferred from the second intermediate transfer drum 3 onto a recording sheet P by a final transfer roll 4 which is in contact with the second intermediate transfer drum 3 at the end.

There are two first intermediate transfer drums 2, each provided to the image forming engines for two colors. Onto one first intermediate transfer drum 2*a*, the toner image is transferred from the image forming engines 1Y and 1M for yellow and magenta, and onto the other first intermediate transfer drum 2*b*, the toner image is transferred from the image forming engines 1K and 1C for black and cyan. Thus, the toner images in two colors are overlapped on each of the first intermediate transfer drums 2*a* and 2*b*. Also, the second intermediate transfer drum 3 is in contact with both of the pair of the first intermediate transfer drums 2*a* and 2*b*. After the toner image in yellow and magenta is transferred from the one first intermediate transfer drum 2*a*, the toner image in black and cyan is transferred from the other first intermediate transfer drum 2*b*. Thus, the toner images in four colors are overlapped on the second intermediate transfer drum 3. Also, the recording sheet P onto which the toner image has been transferred passes through a fixing device 5 to be discharged to a not-shown sheet discharging tray.

Accordingly, in the printer of this embodiment, judging from the rotational direction of the first intermediate transfer drums 2*a* and 2*b* and the second intermediate transfer drum 3, a processing distance in which the toner image in each color reaches from the image forming engine to a final transfer position of the recording sheet P becomes longer in the order of black, cyan, yellow, and magenta. If the toner images in these four colors are overlapped on the second intermediate transfer drum 3, the write timing of the toner image in the image forming engine 1M for magenta comes first.

Each of the image forming engines 1 is composed of the photosensitive drum 10, a charging roll 11 for charging the photosensitive drum 10 to a predetermined background potential, a laser optical unit (not shown) for exposing the photosensitive drum 10 using a light beam Bm which has been modulated by image information, a developing device 12 for toner-developing an electrostatic latent image which has been formed on the photosensitive drum 10 due to the exposure, and a toner temporarily-holding member 13 for removing an unnecessary toner from the surface of the photosensitive drum 10 onto which a toner image has been primarily transferred and temporarily holding the toner. The first intermediate transfer drums 2*a* and 2*b* are each in contact with the photosensitive drum 10 on the downstream side of the developing device 12. Thus, as the photosensitive drum 10 rotates, the processes of charging, exposure, development, and transfer are consecutively performed to the surface of the photosensitive drum 10, and the toner image corresponding to the image information of each color is primarily transferred onto one of the first intermediate transfer drums 2*a* and 2*b*.

Among the structural members described above, the photosensitive drum 10, the charging roll 11, and the toner temporarily-holding member 13 which correspond to each color are integrally formed into a single drum unit 6. Also, a pair of the first intermediate transfer drums 2*a* and 2*b* and the second intermediate transfer drum 3 are integrally formed into a single image transferring unit 7. For example, if the image quality is deteriorated due to degradation of the photosensitive drum 10 or the like, the drum unit 6 should be replaced as it is together with the charging roll 11.

The charging roll 11 is formed by covering the periphery of a shaft member formed of a conductive metal with a conductive foaming elastic member. In order to prevent a toner from blocking a void of the foaming elastic member, the periphery of the elastic member is covered with a cylindrical rotary film having conductivity. To the shaft member, a DC voltage of approximately −1100 V is applied. Thus, a discharge takes place in a minute cuneiform gap formed by the periphery of the rotary film and the periphery of the photosensitive drums 10, and then the surface of the photosensitive drums 10 is uniformly charged to, for example, approximately −750 V.

A bias voltage applied to the charging roll 11 is preferred to include only a DC component as described above, but may include the DC component superposed on an AC component. However, the AC component is higher in aggressiveness toward the surface of the photosensitive drum 10 than the DC component, so that the surface smoothness of the photosensitive drum is likely to be impaired due to its use over time. Therefore, in order to maintain a transfer efficiency for a toner image at a high level over a long period of time, it is preferred that the bias voltage including only the DC component be applied to the charging roll 11, and the photosensitive drum 10 be charged to a predetermined background potential.

Also, the developing device 12 adopts a so-called magnetic brush developing system. The developing device of each of the image forming engines 1Y, 1M, 1K, and 1C of the respective colors is filled with a developer containing a toner of the correspond color and a carrier. Each developing device 12 includes a developing roll 14 opposing the photosensitive drum 10 with a predetermined gap maintained. The developer is formed into a magnetic brush on the developing roll 14 so as to slidingly contact the photosensitive drum 10 as the developing roll 14 rotates. Also, a developing bias voltage in which the DC component is superposed on the AC component is applied to the developing roll 14. By causing the magnetic brush of the developer to slidingly contact the photosensitive drum 10 while the developing bias voltage is applied thereto, a toner adheres only to an image portion on the photosensitive drum 10 exposed by the light beam Bm to form a toner image. In this embodiment, for example, the potential of the image portion after exposure by the light beam Bm is set to −75V or less, the AC component of the developing bias voltage are set to 4 kHz and 1.5 kvpp, and the DC component of the developing bias voltage are set to −300 V.

As the toner, a spherical toner having a form factor value MLS2 of 130 or less is preferably used. Such a spherical toner is satisfactory in releasability from the photosensitive drum 10, so that the transfer efficiency can be improved when the toner image is primarily transferred from the photosensitive drum 10 onto one of the first intermediate transfer drums 2*a* and 2*b*. Therefore, the spherical toner is optimally used in the case of realizing a so-called cleanerless structure in which a cleaner is not provided to the photosensitive drum 10.

Further, the toner temporarily-holding member 13 is a brush roll in which each piece of conductive scraper fur is erected on the periphery of a metallic rotation shaft. In order to prevent a toner from adhering to the charging roll 11, the toner temporarily-holding member 13 is disposed on the upstream side of the charging roll 11 with respect to a rotational direction of the photosensitive drum 10. By causing the toner temporarily-holding member 13 to slidingly contact the photosensitive drum 10, the normal-polarity toner and the reversed-polarity toner which are adhered to the surface of the photosensitive drum 10 after the toner image is primarily transferred are removed, and a discharge product which is adhered to the photosensitive drum 10 at the time of charging by the charging roll 11 is removed, to thereby prevent these substances from adhering to the surface of the charging roll 11 on the downstream side. As a result of increasing the transfer efficiency for the toner image from the photosensitive drum 10 onto the first intermediate transfer drums 2*a* and 2*b*, there hardly occurs normal-polarity toner remaining on the photosensitive drum 10. Therefore, a bias voltage for actively recovering a reversed-polarity toner is applied to the toner temporarily-holding member 13. However, even if such a bias voltage is applied, the toner temporarily-holding member 13 mechanically and slidingly contacts the surface of the photosensitive drum 10, so that a small amount of the normal-polarity toners remaining on the photosensitive drum 10 are also adhered to the toner temporarily-holding member 13.

Also, as a result of increasing the transfer efficiency for the toner image, there remain an extremely small amount of the normal-polarity toners and the reversed-polarity toners which are adhered to the surface of the photosensitive drum 10 after the toner image is transferred. Therefore, the toner temporarily-holding member 13 does not include a mechanism for discharging the unnecessary toner and the discharge product which have been removed from the photosensitive drum 10 to the outside of the process, that is, a detoning mechanism. In other words, the toner temporarily-holding member 13 is used only for temporarily accumulating the unnecessary toners and the like while a print job is executed. The unnecessary toners and the like which are temporarily held are discharged onto the photosensitive drum 10 in a cleaning mode discussed later and then discharged to the outside of the process by the toner discharging member 20 provided in each of the first intermediate transfer drums 2*a* and 2*b*. As described above, it is unnecessary to provide a detoning mechanism for the unnecessary toner to each of the image forming engines 1. As a result, each of the image forming engines 1 becomes extremely compact, which contributes to miniaturization of the entire printer.

Note that, in FIG. 1, the description has been made by indicating the symbols for the image forming engine 1Y for yellow, but the image forming engines 1M, 1K, and 1C for the other colors also has completely the same structure.

On the other hand, the first intermediate transfer drums 2 and the second intermediate transfer drum 3 are formed by covering a metal pipe containing Fe, Al, etc. with a low resistance elastic layer ($R=10^2$ to $10^3$ Ω) such as a conductive silicone rubber having a thickness of approximately 0.1 to 10 mm. Further, on the surface of the low resistance elastic layer, a fluororubber layer (the resistance R is approximately $10^5$ to $10^9$ Ω) having a thickness of 3 to 100 μm is provided as a highly releasable layer and is bonded thereto using an adhesive of a silane coupling agent. The resistance of the second intermediate transfer drum 3 is required to be set to higher than that of the first intermediate transfer drum 2. Otherwise, the second intermediate transfer drum 3 charges the first intermediate transfer drum 2, to thereby make it difficult to control the surface potential of the first intermediate transfer drum 2. In this embodiment, the resistance of the first intermediate transfer drum 2 and the resistance of the second intermediate transfer drum 3 are set to approximately $10^8$ Ω and $10^{11}$ Ω, respectively.

The surface potential required for electrostatically transferring the toner image from the photosensitive drum 10 onto the first intermediate transfer drum 2 is approximately +250 to 500V. The optimal surface potential varies depending on the charging state of the toner, the ambient temperature, and the humidity. If the toner charging amount is within a range of −20 to −35 μC/g and under the environment of the room temperature and the room humidity, the surface potential of the first intermediate transfer drum 2 is desired to be approximately +400 V.

Also, the surface potential required for electrostatically transferring the toner image from the first intermediate transfer drum 2 onto the second intermediate transfer drum 3 is approximately +600 to 1200 V. The optimal surface potential varies depending on the charging state of the toner, the ambient temperature, and the humidity similarly to the primary transfer. Also, the potential difference between the first intermediate transfer drum 2 and the second intermediate transfer drum 3 is required for the transfer, so that it is necessary to set the value according to the surface potential of the first intermediate transfer drum 2. As described above, if the toner charging amount is within a range of −20 to −35 μC/g and under the environment of the room temperature and the room humidity and the surface potential of the first intermediate transfer drum 2 is approximately +400 V, it is desired that the surface potential of the second intermediate transfer drum 3 be set to approximately +810V, that is, the potential difference between the first intermediate transfer drum 2 and the second intermediate transfer drum 3 be set to approximately +410 V.

Figure 2:
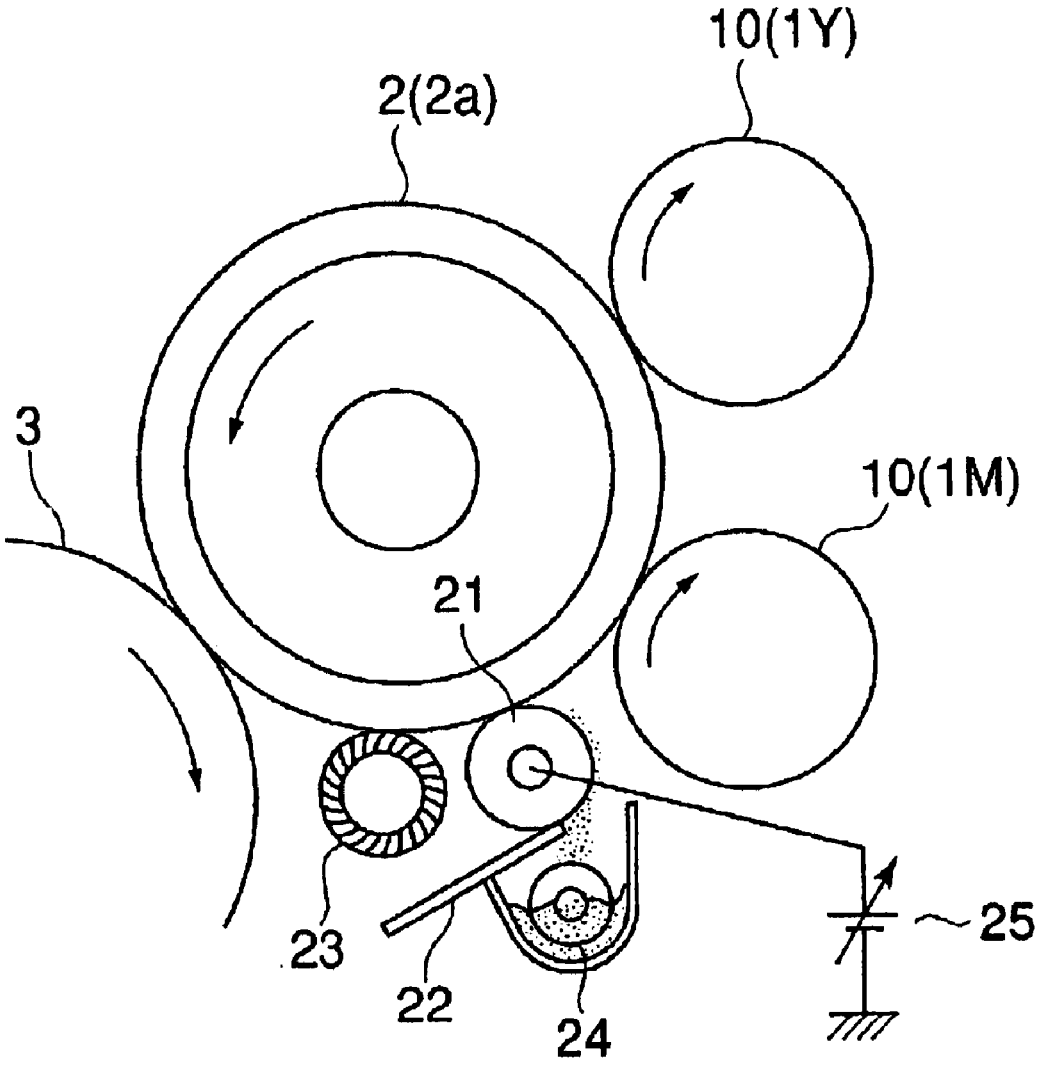
FIG. 2 is an enlarged view showing a structure of a toner discharging member.

Further, in the first intermediate transfer drum 2 and the second intermediate transfer drum 3, there are provided toner discharging members 20 and 30, respectively, for discharging unnecessary toners adhered to these intermediate transfer drums to the outside of the process. As shown in FIG. 2, a first toner discharging member 20 includes a recovery roll 21 made of a metal (for example, SUS material) which rotates while being in contact with the intermediate transfer drum 2 and is applied with the bias voltage, and a cleaning blade 22 made of a metal (for example, SUS material) which is in contact with the surface of the recovery roll 21. The first toner discharging member 20 is structured such that the unnecessary toner on the intermediate transfer drum 2 is made to adhere to the recovery roll 21 by the electrostatic attractive force, and then scraped off from the surface of the recovery roll 21 by using the cleaning blade 22. Thereafter, the unnecessary toner that has been scraped off is conveyed along the axial direction (direction perpendicular to the paper of FIG. 2) of the intermediate transfer drum by means of an auger 24 to be sent to a waste box provided on the front side of the printer. In addition, incompletely the same manner, a second toner discharging member 30 includes a recovery roll 31 and a cleaning blade 32 and is structured such that the unnecessary toner on the intermediate transfer drum 3 is made to adhere to the recovery roll 31 by the electrostatic attractive force, and then scraped off from the surface of the recovery roll 31 by using the cleaning blade 32. Thereafter, the unnecessary toner that has been scraped off is sent by the auger to the waste box used in common with the first toner discharging member 20.

The rotational driving force is directly transmitted from the recovery roll 21, 31 to the intermediate transfer drum 2, 3. That is, a gear provided to an end portion of the recovery roll 21, 31 is interlocked with a gear provided to an end portion of the intermediate transfer drum 2, 3, so that the recovery roll 21, 31 rotates in synchronism with the intermediate transfer drum 2, 3. In order that the toner is efficiently transited from the intermediate transfer drum 2, 3, a peripheral speed difference is given to the recovery roll 21, 31 with respect to the peripheral speed of the intermediate transfer drum 2, 3. Therefore, a shearing force is acted by the recovery roll 21, 31 on the toner adhered to the intermediate transfer drum 2, 3. However, if the shearing force is excessively large, the toners are crushed to be fixed on the intermediate transfer drum 2, 3. Therefore, it is preferred to set the above peripheral speed difference within 2% of the peripheral speed of the intermediate transfer drum 2, 3.

Also, in order that the toner adhered to the intermediate transfer drum 2, 3 is efficiently transited to the recovery roll 21, 31, it is necessary that the recovery roll 21, 31 be in contact with the intermediate transfer drum 2, 3 at a certain level of pressure and the elastic layer of the intermediate transfer drum 2, 3 is flexed, to thereby form a nip region between both. Therefore, the recovery roll 21, 31 is disposed in the image transferring unit 7 together with the intermediate transfer drum 2, 3 in the state where the distance between the rotation shaft of the recovery roll 21, 31 and the rotation shaft of the intermediate transfer drum 2, 3 is strictly determined. On the other hand, without determining the distance between the rotation shafts as described above, by providing a tracking rolls on both shaft ends of the recovery roll 21, 31 and bringing the tracking rolls into pressure contact with the intermediate transfer drum 2, 3, a predetermined nip region may be formed between the recovery roll 21, 31 and the intermediate transfer drum 2, 3.

Further, in order that the toner adhered to the intermediate transfer drum 2, 3 is transited to the recovery roll 21, 31 by the electrostatic attractive force, a potential gradient is required to be formed between the intermediate transfer drum 2, 3 and the recovery roll 21, 31. In FIG. 2, in order to form the potential gradient, a variable power source 25 is connected to the recovery roll 21, 31 and a cleaning bias including a DC component is applied to the recovery roll 21, 31. This cleaning bias is variable. The cleaning biases with different sizes and different polarities between the case of executing a print job and the case of executing the cleaning mode discussed later are applied to the recovery roll 21, 31 to control the polarity of the toner to be transited from the intermediate transfer drum 2, 3 to the recovery roll 21, 31.

While the print job is executed, the reversed-polarity toner is removed from the first intermediate transfer drum 2 by means of the first toner discharging member 20 provided to the first intermediate transfer drum 2. This is because the reversed-polarity toner generated when the toner image is finally transferred onto the recording sheet P and the reversed-polarity toner generated when the toner image is secondarily transferred onto the second intermediate transfer drum 3 are prevented from being transited backward along the potential gradient to adhere to the photosensitive drum 10. Particularly, this is important when other toners in another color are prevented from mixing into the developing devices 12 of magenta and cyan.

To the contrary, while the print job is executed, the normal-polarity toner is removed from the second intermediate transfer drum 3 by means of the second toner discharging member 30 provided to the second intermediate transfer drum 3. When a full-color image is formed, toner images in four colors are overlapped on the second intermediate transfer drum 3. Thus, more untransferred toners are likely to remain on the surface of the second intermediate transfer drum 3 after the final transfer compared with the first intermediate transfer drum 2. Accordingly, if the normal-polarity toner which has not been transferred to the recording sheet P is not reliably removed from the surface of the second intermediate transfer drum 3, the normal-polarity toner rotates around the second intermediate drum 3 to be transferred onto the recording sheet P as a ghost image.

In the toner discharging member 20, 30 structured and used as described above, the toner adhered to the intermediate transfer drum 2, 3 is transited to the recovery roll 21, 31 by the electrostatic attractive force, and then scraped off from the recovery roll 21, 31 by the cleaning blade 22, 32, so that it becomes unnecessary for the cleaning blade 22, 32 to directly contact the intermediate transfer drum 2, 3. Therefore, even if, taking into account the use of the spherical toner, the cleaning blade 22, 32 is formed of a metal thin plate such as the SUS material, the intermediate transfer drum 2, 3 is not subject to damage, thereby being capable of maintaining a satisfactory transfer efficiency for a toner image over a long period of time.

On the other hand, in the first intermediate transfer drum 2*a*, 2*b* and the second intermediate transfer drum 3, there are provided toner temporarily-holding members 23 and 33, respectively, which are the same as that provided for the photosensitive drum 10. The toner temporarily-holding member (hereinafter, referred to as "first cleaner") 23 provided for the first intermediate transfer drum 2 slidingly contacts the surface of each first intermediate transfer drum 2 between the secondary transfer position of the toner image and the first toner discharging member 20, and captures the normal-polarity toner by being applied with the bias voltage while the print job is executed. Normally, the normal-polarity toner is transferred from the first intermediate transfer drum 2 onto the second intermediate transfer drum 3. Thus, the normal-polarity toner captured by the first cleaner 23 is the residual toner which has not been secondarily transferred. However, in the case of the secondary transfer, the toner images in only two colors are transferred onto the second intermediate transfer drum 3, so that there are less untransferred residual toners than in the case of the final transfer. As a result, the first cleaner 23 including no detoning mechanism is structured to remove the normal-polarity toner on the first intermediate transfer drum 2.

Also, the toner temporarily-holding member (hereinafter, referred to as "second cleaner") 33 provided for the second intermediate transfer drum 3 slidingly contacts the surface of the second intermediate transfer drum 3 between the second toner discharging member 30 and the first intermediate transfer drum 2, and captures the normal-polarity toner by being applied with the bias voltage while the print job is executed, similarly to the second toner discharging member 30. That is, the normal-polarity toner remaining on the second intermediate transfer drum 3 after the final transfer is first removed by the second toner discharging member 30, and another normal-polarity toner still remaining thereon is further removed also by the second cleaner 33, to thereby carefully prevent the ghost image from occurring.

Figure 3:
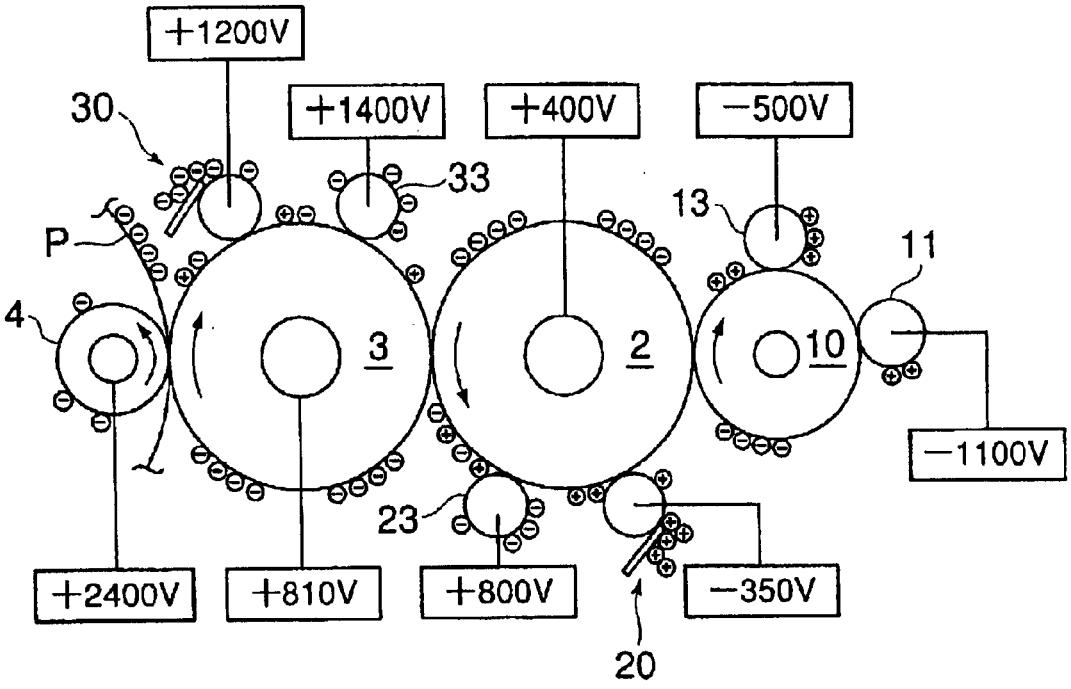
FIG. 3 is an explanatory view showing a flow of toners during a print job in a printer according to an embodiment.

FIG. 3 shows a simplified flow of toners during the print job, that is, while the toner image formed on the photosensitive drum 10 is being transferred onto the recording sheet P. During an image forming job, the toner charged to the normal polarity (negative polarity in this embodiment) is primarily transferred from the photosensitive drum 10 onto the first intermediate transfer drum 2, then secondarily transferred onto the second intermediate transfer drum 3, and finally transferred onto the recording sheet P. However, the reversed-polarity toner generated in the primary transfer is captured by the toner temporarily-holding member 13 on the way backward to the charging roll 11. Also, the residual normal-polarity toner which has not been transferred from the first intermediate transfer drum 2 onto the second intermediate transfer drum 3 is captured by the first cleaner 23 on the way backward to the photosensitive drum 10. Moreover, the residual normal-polarity toner which has not been transferred from the second intermediate transfer drum 3 onto the recording sheet P is discharged to the outside of the process by the second toner discharging member 30 on the way backward to the first intermediate transfer drum 2. The residual toner which has passed through this second toner discharging member 30 is captured by the second cleaner 33. On the other hand, the reversed-polarity toner whose polarity has been reversed in the final transfer is transferred from the second intermediate transfer drum 3 onto the first intermediate transfer drum 2 in the backward direction, and discharged to the outside of the process by the first toner discharging member 20. Note that the numerical values in the drawing denote bias voltages applied to the respective members.

Figure 4:
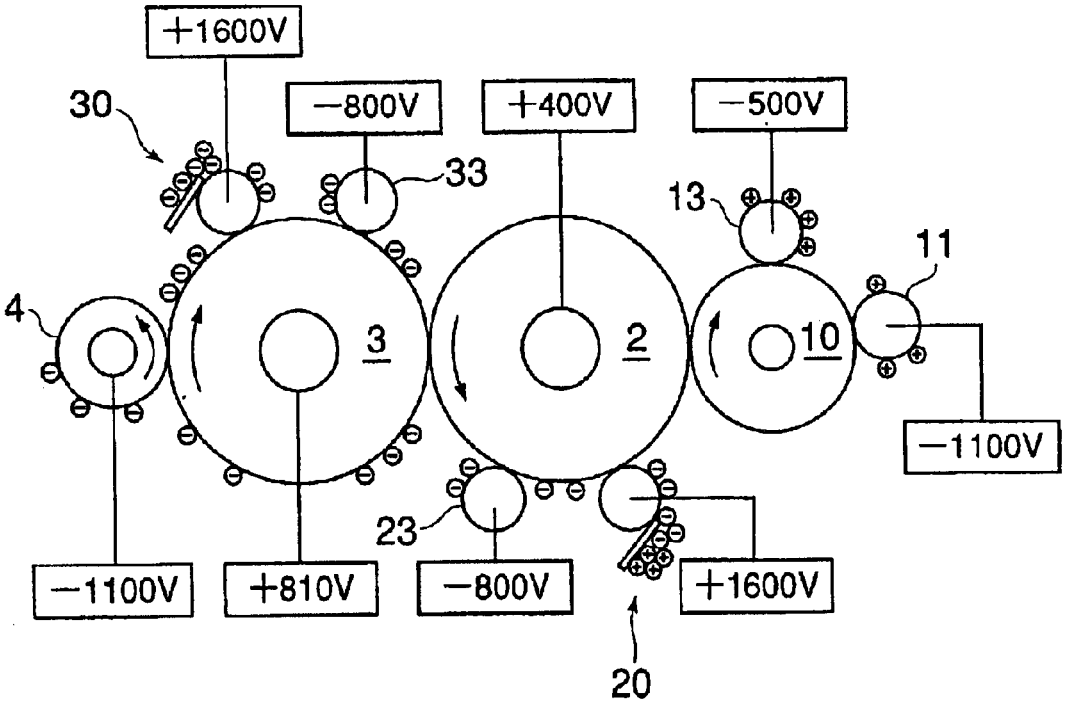
FIG. 4 is an explanatory view showing a flow of toners in a first step of a cleaning mode in the printer according to the embodiment.
Figure 5:
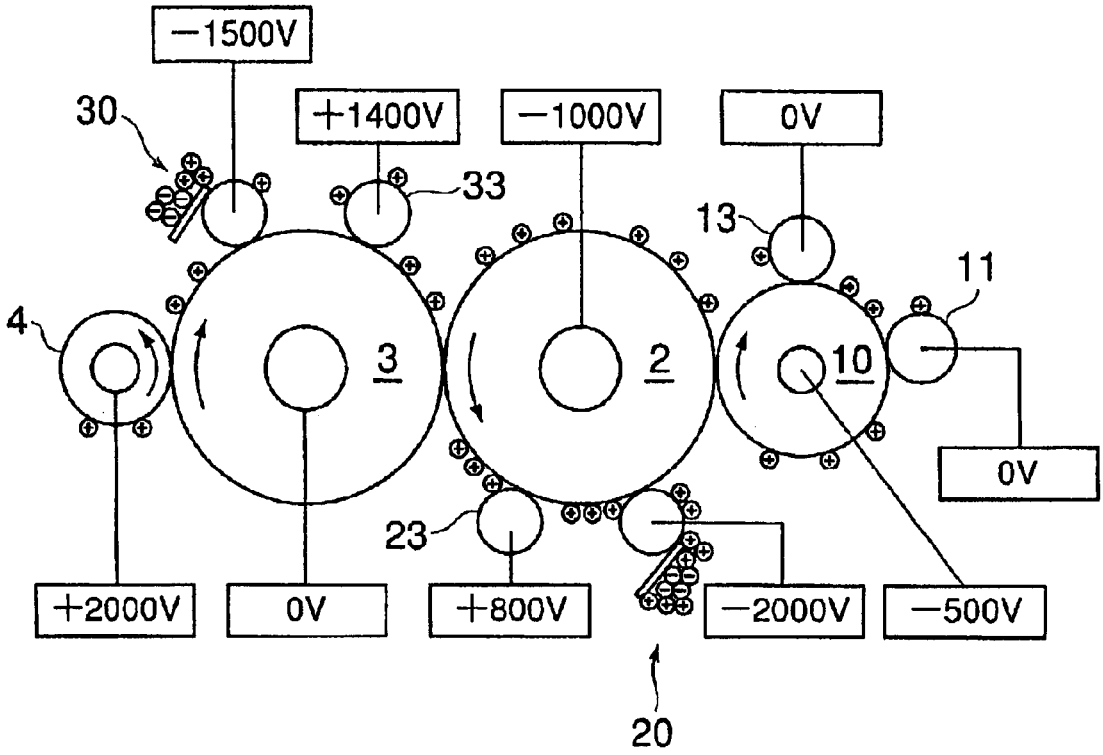
FIG. 5 is an explanatory view showing a flow of toners in a second step of the cleaning mode in the printer according to the embodiment.

To the contrary, FIGS. 4 and 5 show the cleaning mode which is executed between the print jobs. The cleaning mode is formed of two steps; FIG. 4 shows the flow of toners in a first step and FIG. 5 shows the flow of toners in a second step.

First, in the first step of the cleaning mode, the normal-polarity toners captured by the first cleaner 23 and the second cleaner 33 are discharged to the outside of the process, and the normal-polarity toner adhered to the final transfer roll 4 is discharged to the outside of the process. As has already been described above, the normal-polarity toners are captured by both the first cleaner 23 and the second cleaner 33 while the print job is executed, but the normal-polarity toners are also transited from the second intermediate transfer drum 3 onto the final transfer roll 4, and the normal-polarity toners are gradually accumulated on the surface of the final transfer roll 4. Therefore, the normal-polarity toners adhered to the final transfer roll 4 cause a stain on the back surface of the recording sheet P and also cause transfer deficiency of the toner image onto the recording sheet P. Accordingly, when the first step is started, the polarities of the bias voltages applied to the first cleaner 23, the second cleaner 33, and the final transfer roll 4 are reversed, and the normal-polarity toner captured by the first cleaner 23 is discharged onto the first intermediate transfer drum 2, while the normal-polarity toners adhered to the second cleaner 33 and the final transfer roll 4 are discharged onto the second intermediate transfer drum 3. Then, the normal-polarity toners discharged onto the second intermediate transfer drum 3 are further discharged to the outside of the process by the second toner discharging member 30. Also, the polarity of the bias voltage applied to the first toner discharging member 20 is reversed, and the normal-polarity toner discharged onto the first intermediate transfer drum 2 by the first cleaner 23 is further discharged to the outside of the process by the first toner discharging member 20. Note that the numerical values in the drawing denote bias voltages applied to the respective members.

Subsequently, in the second step of the cleaning mode, the reversed-polarity toner captured by the toner temporarily-holding member 13 or adhered to the charging roll 11 is discharged to the outside of the process. Also, the reversed-polarity toners unintentionally adhered to the first cleaner 23, the second cleaner 33, and the final transfer roll 4 are simultaneously discharged to the outside of the process. When the second step is started, the potential gradient formed between the photosensitive drum 10 and the toner temporarily-holding member 13 or the charging roll 11 is reversed, and the reversed-polarity toners are discharged from the toner temporarily-holding member 13 and the charging roll 11 onto the photosensitive drum 10. The discharged reversed-polarity toners are transited from the photosensitive drum 10 to the first intermediate transfer drum 2 and further discharged to the outside of the process by the first toner discharging member 20. Also, the potential gradient reverse to that in the first step is formed between the second intermediate transfer drum 3 and the second cleaner 33 or the final transfer roll 4, and the reversed-polarity toner adhered to the second cleaner 33 and the final transfer roll 4 is discharged onto the second intermediate transfer drum 3. The reversed-polarity toner discharged from the second cleaner 33 is transited from the second intermediate transfer drum 3 to the first intermediate transfer drum 2 and further discharged to the outside of the process by the first toner discharging member 20. On the other hand, the reversed-polarity toner discharged from the final transfer roll 4 onto the second intermediate transfer drum 3 is further discharged to the outside of the process by the second toner discharging member 30. Note that the numerical values in the drawing denote bias voltages applied to the respective members.

Thus, the normal-polarity toners and the reversed-polarity toners which are adhered to the charging roll 11, toner temporarily-holding member 13, the first cleaner 23, the second cleaner 33, and the final transfer roll 4 during the print job can be discharged to the outside of the process. In the subsequent print job following this cleaning mode, it becomes possible to use these members that are refreshed to perform image formation. As a result, it becomes possible to form the recorded image with a high quality and without uneven density or occurrence of a ghost image on the recording sheet P.

As has been described above, the image forming apparatus of the present invention is structured as follows. That is, when the toner adhered to the intermediate transfer drum is captured and discharged as waste into the recovery box, the toner on the intermediate transfer drum is transited to the surface of the recovery roll which is in contact with the intermediate transfer drum, and the toner adhered to the surface of the recovery roll is scraped off by using a scraper. Consequently, the untransferred residual toner can be reliably removed from the surface of the intermediate transfer drum which is covered with the elastic layer, thereby being capable of forming the recorded image having a high image quality such that no ghost image occurs. Further, it becomes possible to continue to form the recorded images having the high image quality over a long period of time without causing damage to the intermediate transfer drum.

What is claimed is:

1. An image forming apparatus comprising:

an image bearing member on which a toner image corresponding to image information is formed;

a final transfer roll for transferring the toner image onto a recording sheet;

at least one intermediate transfer member for mediating a transfer of the toner image from the image bearing member onto the recording sheet, which is disposed between the image bearing member and the final transfer roll;

a toner discharging member for capturing a toner adhered on the intermediate transfer member and discharging the toner as waste into a recovery box, which is disposed to oppose the intermediate transfer member;

a cleaning mode executed while an image forming operation is not executed, wherein a potential gradient formed between the intermediate transfer drum and the recovery roll is reversed between a case of the image forming operation and a case of executing the cleaning mode; and a toner temporarily-holding member for electrically capturing a toner adhered on a surface of the intermediate transfer drum, which is in contact with the surface of the intermediate transfer drum and is provided on an upstream side of the toner discharging member with respect to a rotational direction of the intermediate transfer drum, wherein;

during the image forming operation, the toner discharging member and the toner temporarily-holding member each remove an unnecessary toner having a polarity reverse to each other from the surface of the intermediate transfer drum; and when the cleaning mode is executed, the unnecessary toner captured by the toner temporarily-holding member is transited to the intermediate transfer drum to be removed by the toner discharging member; and further wherein:

the intermediate transfer member is structured as an intermediate transfer drum in which a periphery of a metal base formed into a cylindrical shape is covered with an elastic layer; and the toner discharging member comprises;

a recovery roll that rotates while being in contact with the intermediate transfer drum; and a scraper for scraping off a toner adhered to a surface of the recovery roll, wherein the recovery roll is a metallic conductive roll and the scraper is a metal plate whose edge corner portion is abutted against a peripheral surface of the recovery roll, and wherein a cleaning bias is applied to the recovery roll and the recovery roll electrically adsorbs a residual toner on the intermediate transfer drum.

2. An image forming apparatus according to claim 1, wherein a peripheral speed of the recovery roll has a speed difference with respect to a peripheral speed of the intermediate transfer drum.

3. An image forming apparatus according to claim 1, wherein the recovery roll is grounded via a resistor and electrically adsorbs a residual toner on the intermediate transfer drum.

* * * * *